United States Patent [19]

Sivilotti

[11] 4,008,750

[45] Feb. 22, 1977

[54] CONTINUOUS CASTING OF METALS

[75] Inventor: Olivo Giuseppe Sivilotti, Kingston, Canada

[73] Assignee: Alcan Research and Development Limited, Montreal, Canada

[22] Filed: Apr. 15, 1975

[21] Appl. No.: 568,311

[52] U.S. Cl. ..... 164/87; 164/278

[51] Int. Cl.[2] ..... B22D 11/06

[58] Field of Search ..... 164/87, 278; 198/202; 226/15, 191; 29/113 R; 74/241, 242, 299; 26/63

[56] References Cited

UNITED STATES PATENTS

| | | | |
|---|---|---|---|
| 3,106,767 | 10/1963 | Fox | 26/63 X |
| 3,123,874 | 3/1964 | Hazelett et al. | 164/278 X |
| 3,452,809 | 7/1969 | Dumont-Fillon | 164/278 |
| 3,482,620 | 12/1969 | Dumont-Fillon | 164/278 |
| 3,726,588 | 4/1973 | Moser | 355/16 X |
| 3,878,883 | 4/1975 | Hazelett et al. | 164/278 |

*Primary Examiner*—Ronald J. Shore
*Attorney, Agent, or Firm*—Cooper, Dunham, Clark, Griffin & Moran

[57] ABSTRACT

In apparatus for continuously casting metals between endless moving belts, a pulley device for carrying a casting belt, including outer, belt-supporting structure having at least two belt-engaging surface zones respectively located on opposite sides of the median plane of the pulley, wherein at least one of the two zones is variable in circumference with respect to the other of the two zones for adjusting the transverse profile of the belt-supporting surface of the pulley. The pulley device in one form comprises a belt-supporting structure which is circumferentially expansible at each of two surface zones and means for effecting controlled expansion of the structure separately at each of the two zones. A method of steering a casting belt, in continuous casting procedure, includes the steps of advancing the belt over a pulley around which the belt is trained and varying the circumference of one surface zone of the pulley with respect to another surface zone of the pulley for adjusting the lateral contour of the pulley surface to counteract a tendency of the belt to move laterally on the pulley.

15 Claims, 7 Drawing Figures

CONTINUOUS CASTING OF METALS

BACKGROUND OF THE INVENTION

This invention relates to the continuous casting of metals in strip form between a pair of moving surfaces constituted by endless flexible heat-conducting bands or belts, as in a so-called twin-belt caster wherein the belts are trained over pulleys or the like. More particularly, the invention is directed to improvements in belt pulley devices, and belt-steering methods employing such pulleys, in twin-belt continuous casting apparatus and procedures.

In exemplary belt-casting apparatus of the type herein contemplated, a pair of endless metal belts are caused to travel in substantially parallel paths so as to define a mold space between them, closed at its sides by suitable edge dams. The molten metal is supplied to one end of the space and discharged from between the moving belts at the exit end, as a fully solidified strip of predetermined thickness in the range from the thickness of slab to relatively thin plate or sheet. Arrangements have been provided for cooling the reverse faces of the belts, to remove heat as necessary for solidifying the metal.

It is of great importance, in such apparatus, to maintain exact positional stability of each belt in a precise, desired path. Typically, the belts are trained over drive pulleys, i.e. suitably driven rotary members for imparting continuous unidirectional motion to the belts, as well as over guide pulleys or rollers or other bearings cooperatively defining the path of belt movement. As casting operation proceeds, the belts (which are in the nature of relatively wide metallic webs) commonly tend to undergo lateral displacement with respect to the pulleys, owing to such factors as transverse taper or other departure from flatness of the belts, differential thermal strains on the belts, and/or variations in pulley diameter from side to side of the pulleys. This lateral wandering of the belts may indeed be progressive in character, so that the belts exhibit increasingly severe positional deviation over the course of a number of revolutions. It is accordingly necessary to provide corrective measures in order to maintain proper positional alignment of the belts with the centerline of the casting apparatus.

Expedients heretofore employed or proposed for this purpose have included arrangements for elastically affecting the belt length differential (from side to side) and/or moving the belt-pulley system sideways to keep the belt aligned with the casting apparatus centerline. These expedients are, however, structurally and operationally complex and in many cases inconvenient.

SUMMARY OF THE INVENTION

It is an object of the invention to provide, in twin-belt continuous casting apparatus and procedures, new and improved devices and methods for steering a casting belt, i.e. for controlling the lateral position of the belt so as to correct any tendency of the belt to wander or deviate from proper alignment with the centerline of the casting equipment. A further object is to provide such devices and methods for achieving belt steering in a simple and convenient manner that obviates resort to such expedients as adjustment of belt tension differential and/or lateral movement of a belt-supporting pulley.

To these and other ends, the present invention broadly contemplates, in apparatus for the continuous casting of metal in strip form comprising a pair of moving belts which define a mold space between them and continuously travel through return paths to the mold space, the combination, with one of the belts, of a pulley device which carries the belt through a change of direction in its return path while steering the belt against sidewise displacement. In accordance with the invention, this pulley device comprises a pulley including outer, belt-supporting structure for engaging the belt in at least two surface zones respectively located on opposite sides of the median plane of the pulley and variable in circumference at least at one of the zones; and means controllable to effect variation in the circumference of the structure at the latter zone (relative to the circumference of the structure at the other zone) for adjusting the transverse profile of the outer surface of the pulley to keep the belt in a desired path on the pulley. The term "median plane of the pulley," as used herein, refers to the plane, perpendicular to the axis of pulley rotation, which bisects the pulley.

In use of the pulley device of the invention, having a belt or web trained around it, the pulley diameter can be made to vary from side to side of the pulley. By effecting such variation in diameter (i.e. transverse profile) of the pulley in response to a tendency of the web or belt to "climb" sideways, that tendency will stop and reverse direction without the need to change the tension distribution in the web. In other words, if the web length has a taper of X% per inch of width and the pulley diameter is adjusted to have approximately the same (appropriately oriented) taper of X% per inch of width, the web will not have any reason to climb sideways; and if the taper of the pulley diameter is made to exceed the taper of the web, the web will reverse its direction of climb and move back toward the centerline of the equipment.

In order to be able to correct web climbing or sideways deviation in either lateral direction, the circumferential variability of the pulley device is arranged to enable the circumference (or diameter) of the aforementioned one zone of the outer supporting structure to be made either less than, equal to, or greater than the circumference (or diameter) of the other of the aforementioned zones. Desirably, in presently preferred embodiments of the invention, the supporting structure is variable in circumference at each of at least the two aforementioned zones, and the controllable means comprises a means for effecting variation in circumference of the structure separately at each of these zones.

As a particularly important feature of the invention, the outer web- or belt-supporting structure may comprise a structure having a plurality of circumferentially expansible zones (e.g. two such zones) distributed axially of the structure, and means controllable to effect expansion of the structure separately at each of these zones for differentially altering the outer diameter of the pulley. Stated with reference to embodiments of the invention wherein two such circumferentially expansible zones are provided in the supporting structure, it is preferred (for optimum effectiveness of a given degree of expansion in counteracting lateral deviation of the web or belt) that these two zones be respectively located near the edges of the structure.

In a specific embodiment of the pulley device incorporating the foregoing features, the outer structure comprises a shell having a normally cylindrical web-carrying surface supported internally at spaced localities (e.g. at its edges and central portion) by an inner structure which has associated means journalling the pulley for rotation. The shell and inner structure cooperatively define a plurality of annular cavities (e.g. two cavities) respectively underlying the expansible portions of the shell. The controllable expanding means comprises means for separately supplying fluid under pressure to each of these annular cavities.

The method of the invention, for steering a travelling casting belt in twin-belt casting apparatus, broadly comprises advancing the belt through a change of direction over a pulley which is arranged with a belt-carrying surface that can be varied in circumference at least at one of plural (two or more) axially distributed belt-supporting zones, sensing a tendency of the belt to move laterally on the pulley, and adjusting the lateral contour of the surface by varying the circumference of the surface at the one zone relative to the circumference at other zone or zones for counteracting that tendency of the web. More specifically, in practice of the method with a pulley having a belt-carrying surface that can be circumferentially expanded separately at least at two zones respectively located on opposite sides of the median plane of the pulley, the circumference-varying step comprises adjusting the lateral contour of the surface by differentially subjecting these zones to expanding force.

Although herein specifically described with reference to belt-type casting apparatus and procedures (e.g. wherein metal is cast in strip form between moving surfaces of which at least one is a surface of an endless belt), the pulley device and method of the invention are more broadly capable of use generally in carrying a travelling web through a change of direction of travel, i.e. in diverse types of equipment or environments (outside of as well as within the casting field) which involves use or handling of a travelling web that is susceptible of lateral deviation, for controlling or counteracting such deviation.

Further features and advantages of the invention will be apparent from the detailed description hereinbelow set forth, together with the accompanying drawings.

DETAILED DESCRIPTION

Figure 1:
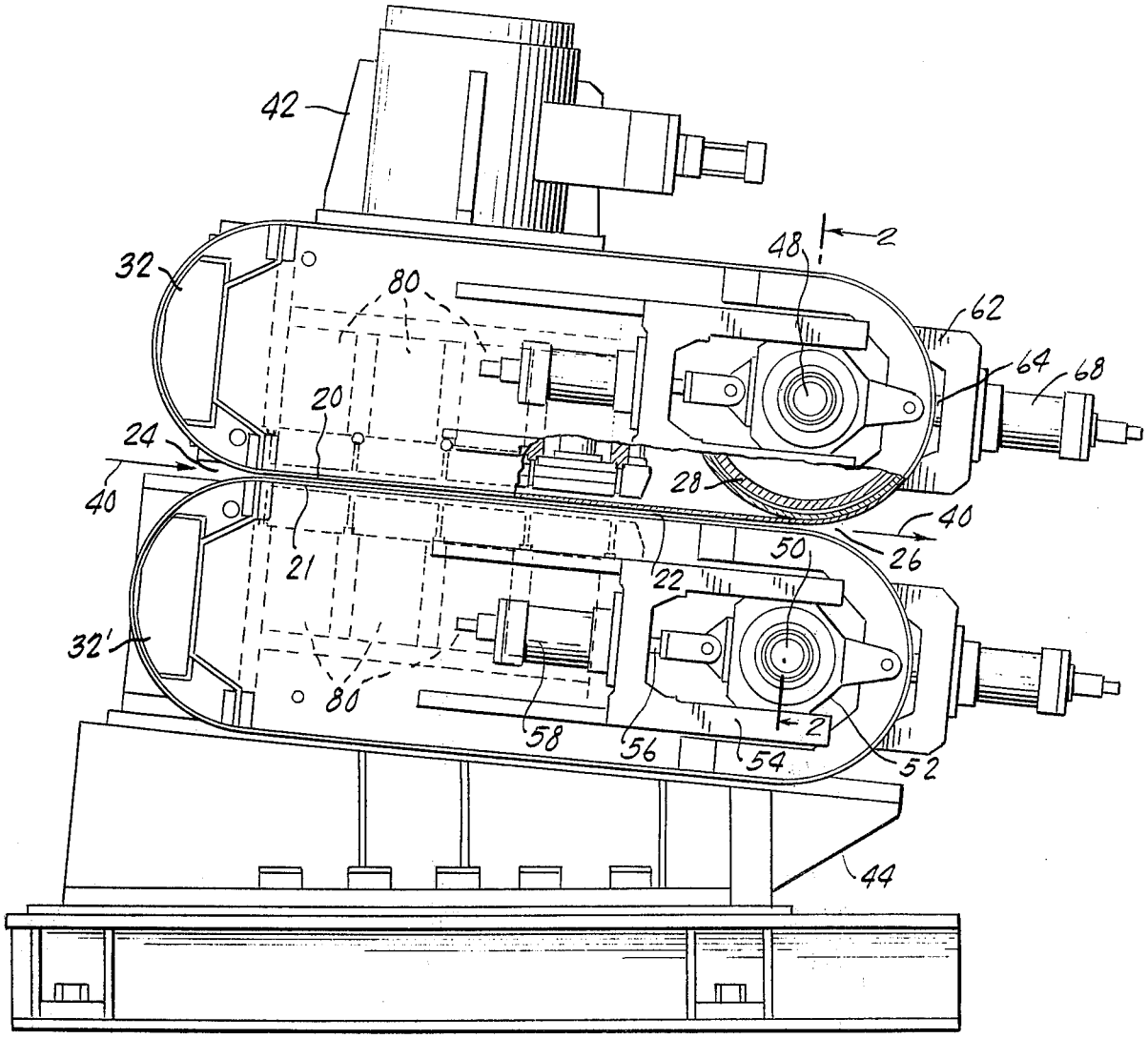
FIG. 1 is a general side view, chiefly in elevation but with a portion in vertical section, of a twin-belt casting apparatus incorporating an illustrative embodiment of the invention, this view being on a smaller scale than the further views in order to enable comprehensive illustration of the apparatus.

For purposes of illustration, the method and device of the invention will be described as embodied in procedure and apparatus for casting a more or less wide continuous strip of aluminum or similar metal.

In the drawings, the various features of the invention are shown as embodied in a twin-belt casting machine in which a pair of resiliently flexible heat conducting belts, e.g. metal belts, are endlessly drawn through a region where they are substantially parallel to each other, with some degree of convergence if desired, so as to define a suitable mold space. Molten metal is continuously supplied into this mold space while the belts are cooled at their reverse surfaces, so that the metal solidifies and continuously emerges as cast strip. For clarity of illustration, various structural and mechanical details that do not directly pertain to the invention are omitted or shown only in simplified or schematic manner. Such parts and details include, for example, further details of the main supporting frame and of the frame structure within each belt loop, motor and gearing connections for the belt driving pulleys, details of the systems for supply of cooling water, and various other auxiliary instrumentalities, all of which will be understood as needed but readily provided in conventional manner or otherwise by ordinary skill, in the light of the following description.

In the illustrated apparatus, the path of the metal being cast, although it may in other embodiments be more oblique or even vertical, is substantially horizontal with a small degree of downward slope from entrance to exit of the actual casting space. Thus the upper and lower endless belts 20 and 21 are arranged so that their faces are essentially parallel to each other (FIGS. 1 and 2) through the region where they define this casting space 22 from its entrance 24 to its exit 26. As will be appreciated, the belts are guided through suitable oval or otherwise looped return paths between their localities 26 and 24. In the present machine, the belt paths are essentially identical ovals, in symmetrically reversed relation above and below the zone 22. Thus the upper belt 20 passes around a cylindrical driving pulley 28 and then travels along an upper path where it may be further supported, if desired, by rows of idler rollers (not shown). The ultimate return about a further semicylindrical path, for this upper belt 20, is achieved by a bearing arrangement generally designated 32. The lower belt 21 follows an essentially identical path including a drive pulley 34 and a final, semicylindrical return bearing 32' similar to the bearing 32 above. The path of metal through the casting apparatus is indicated by arrows 40. The belts themselves are constructed in appropriate manner for casting apparatus of this type, being advantageously of metal, for example, suitably flexible but stiffly resilient steel of appropriately high strength and of such nature that it can be sufficiently tensioned without inelastic yield.

The apparatus, and particularly the belt-carrying structures, can be supported from or in any desired type of framework such as generally indicated by the upright structure 42 and lower or base structure 44 in FIG. 1, all arranged, as will be understood, to hold the belt-holding frameworks in adjustable, pre-set spacing and with appropriate provision (not shown) to permit moving the frameworks apart, for insertion and removal of the belts or for other adjustments and servicing as necessary. The belts may or may not be faced with special surface treatment, e.g. a thermal insulating coating facing the mold space, as has heretofore often been employed in belt casting apparatus.

Figure 2:
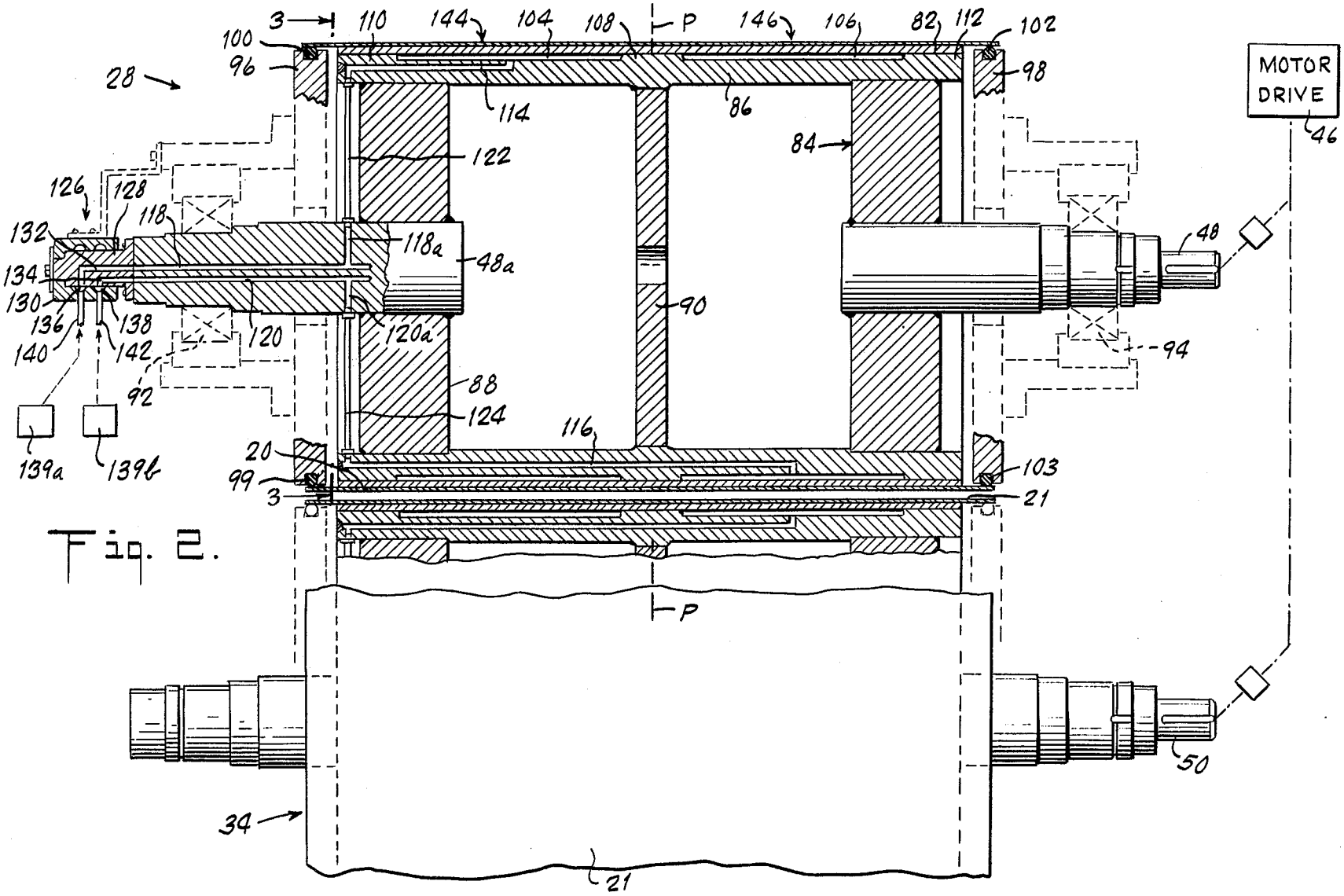
FIG. 2 is an elevational view, partly in section, of the pulley arrangement of the invention in the apparatus of FIG. 1, taken along the line 2—2 of FIG. 1.

The belts 20, 21 are respectively driven by the pulleys 28, 34, as schematically indicated in FIG. 2, with a motor drive 46 having appropriate connections to the shafts 48, 50 of the drive rolls, including suitable gearing and other necessary drive coupling (not shown) as will be readily understood. Although other tensioning means may be employed, the apparatus as shown includes fluid cylinder means for positionally adjusting the shafts 48, 50 and holding them with appropriate tension on the respective belts. As seen in FIG. 1, one end of each of the shafts (e.g., shown for shaft 50) is carried by a journal bearing 52 arranged to be horizontally displaced either way in the direction of the length of the mold space 22, in a sliding support 54 and to be so positioned by a piston 56 in a double-acting hydraulic cylinder 58. The other end of the pulley shaft, e.g. as indicated at the shaft 48 of the roll 28, has a similar journal bearing structure (not shown) sliding in a support 62 and connected to a piston 64 of a similar double-acting hydraulic cylinder 68.

Although not all of these elements are actually here shown for both pulleys, it will be understood that the shafts 48 and 50 of the two driving pulleys are thus each supported at their ends by journal bearings as described, each pair of journal bearings for each pulley having respective positioning cylinders 58 and 68 so that by appropriate adjustment of the cylinders the drive pulley can be located to hold the associated belt in suitable tension for belt-driving operation and other proper functioning of the belt, such adjustment including, if desired, the attainment of a desired exact alignment of the roll axis if required by slight angular movement of the axis in a horizontal plane. It will be understood that although the cylinders 58 and 68 are shown for structural convenience as extending in opposite directions at opposite sides of the assembly, their function is the same as if they both extended in the same direction for each roll.

Molten metal is supplied to the casting zone 22 by a suitable launder or trough (not shown) which is disposed at the entrance end 24 of the apparatus and which may have a structure that is generally of appropriate, known sort. As is usual in belt casting machines, the apparatus is provided with edge dams (not shown), e.g. of conventional character, necessarily at least one at each side, so as to complete the enclosure of the mold cavity 22 at its edges. The dams, e.g. temporarily adhered to one of the belts as endless strips coextensive therewith, are held in suitable longitudinal positions so that when they are compressively engaged between the belts they close the cavity edgewise at the desired transverse dimension and thus keep the molten metal precisely in the path where it is fully cooled through the belts.

Suitable means are provided for cooling and supporting the belts 20 and 21 along the length of the casting space 22, such means being represented schematically at 80 and including nozzles or the like (not shown) for directing coolant water over the surfaces of the belts facing away from the casting space. The specific type of cooling and supporting means utilized in this portion of the apparatus forms no part of the present invention, and accordingly need not be described in detail.

The operation of the apparatus will be readily apparent from all of the foregoing. Molten metal is supplied to an inlet launder or the like where it feeds against the belts 20, 21, converging in their curved paths to the actual casting zone entrance 24. It enters there as a substantially parallel-faced liquid body (with any actual, slight converging taper of the belts if and as desired), and in its carriage through the casting zone 22 to the exit becomes progressively solidified from its upper and lower faces inward (heat from the metal being transferred through the belts and removed therefrom by the coolant supplied by means 80), until it is delivered as continuous, solid, cast strip.

As incorporated in the foregoing apparatus, the present invention is particularly embodied in pulley devices which include the pulleys 28 and 34. As already described, these pulleys respectively constitute the drive means for the two belts 20 and 21. Since the two pulley devices in the present embodiment are identical, only the device including pulley 28 will be described in detail.

As shown, the steel belt 20 is carried by the pulley 28 through a substantially 180° change of direction in the return path of the belt, i.e. downstream of the casting space or mold space 22. In accordance with the invention, pulley 28 comprises a normally cylindrical hollow shell 82 surrounding and supported by a generally cylindrical rigid inner pulley structure 84 to which a shaft 48 is fixedly secured, being so disposed that the structure 84 and shell 82 are coaxial with the shaft and are carried therewith in rotation when the shaft is driven from the motor drive 46.

In the form shown, the inner structure 84 is a relatively heavy steel drum comprising generally cylindrical side wall 86 in which end plates 88 are weldably secured. A central supporting disc 90 is also welded within the drum wall. Shaft 48 is discontinuous, being provided in two sections **48*a* and 48*b* respectively welded to the two end plates 88. At each end, shaft 48 is journalled in a bearing such as the bearing 52 already described with reference to pulley 34, the bearings for shaft 48 being indicated at 92 and 94 in FIG. 2. These bearings are ultimately supported on side frames 96 and 98 of the casting apparatus. A groove 99 formed around the entire edge of the side frame 96 receives an O-ring seal 100 extending around the entire frame and disposed for contact with the adjacent marginal portion of belt 20. A similar O-ring 102 is provided in a groove 103 of the side frame 98.**

The outer surface of the cylindrical wall 86 of drum 84 has formed therein a pair of shallow annular cavities 104 and 106 each extending around the entire periphery of the drum and spaced axially therealong, i.e. disposed on opposite sides of the median plane P—P of the drum. The two cavities are spaced apart by a central rib 108 and are respectively bounded on their outer sides by edge ribs 110 and 112. These three ribs 108, 110 and 112 constitute outwardly projecting surface portions of the drum wall 86 and have their outer faces lying in a common cylindrical surface coaxial with shaft 48.

The shell 82, which has a relatively thin wall and may be fabricated (for example) of low-carbon steel, is fitted over the drum 84 and is substantially coextensive therewith in its axial dimension. This shell is in closely fitted engagement with the outer faces of ribs 108, 110 and 112 which together support the shell on the drum. As formed, the inner diameter of the shell is slightly less than the outer diameter of the drum ribs 108, 110 and 112. In assembling the shell and drum, the shell is preheated until it undergoes expansion sufficient to enable it to be slipped over the drum; once the shell is in place on the drum, it is cooled and thereby caused to shrink tightly against the aforementiond drum ribs. This shrink-fitted arrangement of the shell and drum insures secure, tight, continuously maintained contact between the surfaces of the drum ribs and the portions of the shell inner surface respectively surrounding them.

It will thus be seen that in the assembled pulley the shell is supported at its lateral edges and at a central region by the ribs on the external surface of the drum, while the annular cavities 104 and 106 (now outwardly enclosed by the shell) defined between the ribs provide separate spaces, extending continuously around the drum beneath the shell, for introduction of hydraulic fluid as hereinafter explained. Whereas the drum wall 86 is of substantial thickness, so as not to undergo any significant deformation when subjected to hydraulic pressure as hereinafter described, the shell is thin enough to be elastically deformable by such hydraulic pressure, i.e. at those zones or portions of the shell directly overlying the respective cavities 104 and 106, yet without any separation of the shell from continuous contact with the central and edge ribs 108, 110 and 112.

Figure 3:
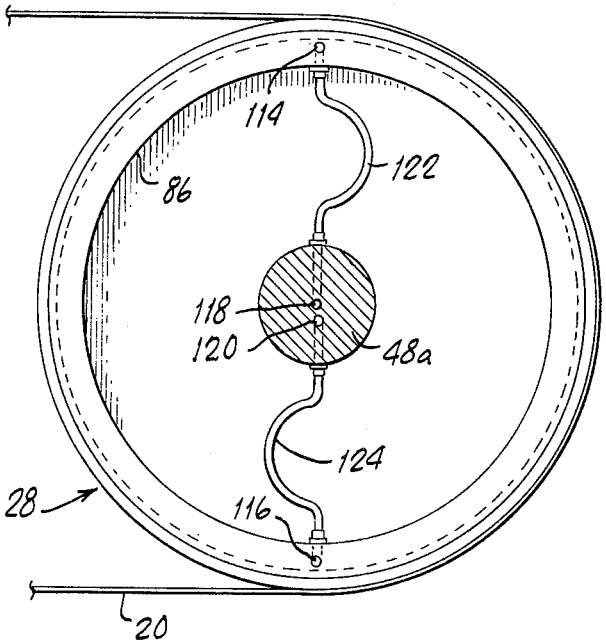
FIG. 3 is an elevational view of one of the pulley devices of FIG. 2, taken along the line 3—3 of FIG. 2.

A fluid passage 114 extends through the drum wall 86 in a generally axial direction from the cavity 104 and opens through the inner surface of the drum wall adjacent the left-hand end thereof as seen in FIG. 2. A similar fluid passage 116 (disposed for convenience in diametrically opposed relation to passage 114) extends from the cavity 106 through the drum wall 86, again in a generally axial direction, and opens through the inner surface of the drum wall also adjacent the left-hand end thereof, the openings of both these passages being as shown outside the left-hand end plate 88. A pair of parallel fluid passages 118 and 120 extend in a generally axial direction through the left-hand portion 48*a* of shaft 48, from the left-hand extremity thereof, and terminate in short lateral legs (respectively designated 118*a* and 120*a* ) opening through the side surface of shaft portion 48*a* in generally facing relation to the openings of passages 114 and 116 through the inner surface of the drum wall. Passage leg 118*a* is connected to passage 114 by a tube 122 (FIGS. 2 and 3) while passage leg 120*a* is connected to passage 116 through a similar tube 124.

Further in accordance with the invention, means are provided for separately supplying hydraulic fluid to the two passages 118 and 120. These means include a rotating hydraulic union 126 shown schematically in FIG. 2 and comprising a cylindrical element 128 mounted on the left-hand end of shaft portion 48*a* and received in a cylindrical socket of a fixed element 130. A pair of fluid passages 132 and 134 formed in element 128, respectively in register with the shaft passages 118 and 120, respectively communicate with separate annular channels 136 and 138 formed in the side wall of the socket of element 130. Hydraulic fluid is separately supplied, to channels 136 and 138, from a suitable (e.g. conventional) source or sources 139*a*, 139*b* through conduits respectively designated 140 and 142. The sources have separate controls.

In this arrangement of elements, conduit 140, channel 136, passages 132, 118 and 118*a*, tube 122, and passage 114 together define a path for separately conducting hydraulic fluid only to the annular cavity 104, while conduit 142 together with channel 138, passages 134, 120 and 120*a*, tube 124 and passage 116 define a similar path for separately conducting hydraulic fluid only to cavity 106. The structures defining these paths constitute a means for supplying hydraulic fluid under pressure to the cavities, controllable individually by the separate controls of sources 139*a* and 139*b*.

The belt 20 normally engages the outer surface of the shell 82 over the entire axial extent of the shell. Those portions of the shell respectively overlying cavities 104 and 106 constitute zones 144 and 146 at which the shell is circumferentially expansible, i.e. when hydraulic pressure is applied through the aforementioned paths and the respectively subjacent cavities 104 and 106. These two circumferentially expansible zones of the shell are respectively located on opposite sides of the median plane P—P of the pulley and indeed extend in an axial direction to localities respectively near the edges of the pulley structure.

Figure 4:
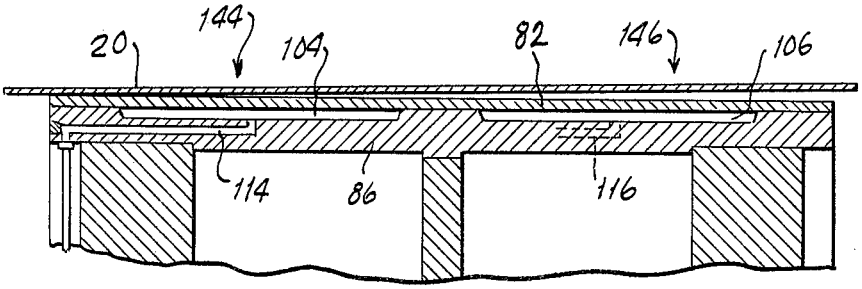
FIGS. 4 and 5 are similar fragmentary sections of the pulley device of FIG. 3, viewed as along the line 2—2 of FIG. 1, illustrating the operation of the pulley device in correcting lateral deviation or climbing of a belt.
Figure 5:
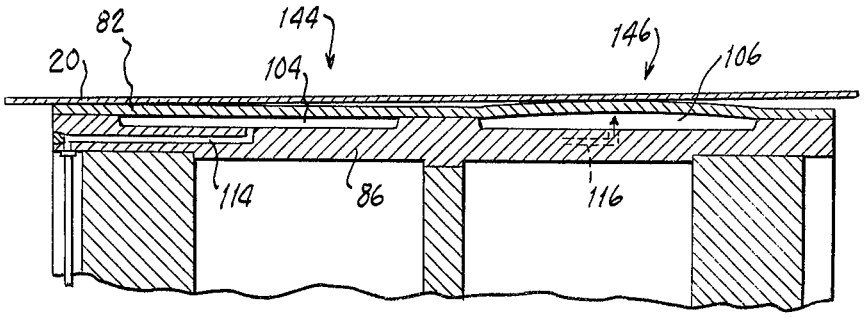

The operation of the pulley device of the invention in its described embodiment, and the practice of the present method, for steering (i.e. correcting lateral deviation) of a belt or web, may now be readily understood. Referring to FIGS. 4 and 5, assuming that the belt 20 exhibits a taper as indicated in exaggerated manner in FIG. 4, such as would tend to cause the belt to climb sideways (or in other words, to undergo progressive lateral deviation from desired alignment with the centerline of the casting apparatus), this climbing tendency may be counteracted by applying hydraulic pressure selectively to cavity 106 (as indicated in FIG. 5) thereby to effect elastic outward deformation of the shell 82 only in zone 146. This selective circumferential expansion of the pulley shell at zone 146 (while the shell at zone 144 remains in unexpanded condition) modifies the transverse contour of the pulley in a way that compensates for the aforementioned taper of the web. That is to say, this selective circumferential expansion of the pulley at only one zone, displaced to one side of the median plane of the pulley, imparts an effective taper or differential in diameter to the pulley that opposes the climbing tendency of the belt or web. Depending on the extent of circumferential expansion at the zone 146, the climbing tendency of the belt may be arrested or even reversed to realign the belt properly with the casting apparatus centerline. By appropriate adjustment of the amount of hydraulic pressure applied through cavity 106 to expand the shell 82 at zone 146, the belt, when properly centered, may be maintained in such centered position notwithstanding its tapered condition.

Similarly, a belt having an oppositely directed taper can be prevented from climbing and returned to and/or maintained in proper alignment, by selective application of hydraulic pressure through cavity 104 to cause selective circumferential expansion of the pulley shell only at zone 144. Stated more generally, in response to a sensed tendency of the web to depart from desired alignment, one or the other of the two expandable zones 144 and 146 is separately and selectively expanded to an extent sufficient to counteract this tendency.

In specific examples of construction of a pulley device in the form shown in FIGS. 2 – 5, the shell made of low-carbon steel has an outer diameter of 15 to 30 inches and is about ½ inch thick, while the drum wall 86 is more than 1½ inch thick. Application of 480 p.s.i. or 240 p.s.i. hydraulic pressure (for 15-inch and 30-inch diameter shells, respectively) causes expansion of the shell (at the zone to which the pressure is applied) in an amount of 3.6 thousandths of an inch (for a 15-inch diameter) or 7.2 thousandths of an inch (for a 30-inch diameter) on the diameter or 0.024% which corresponds to the differential thermal strain on a steel casting belt (i.e. such as would tend to produce sidewise climbing of the belt) resulting from a temperature imbalance of 20° C.

The above-described embodiment of the invention, wherein the pulley device includes an outer shell that is separately circumferentially expansible by application of hydraulic pressure at each of two axially distributed zones, respectively located near the edges of the shell, affords particularly significant advantages for lateral positional control of a travelling belt or web, e.g. with respect to rapidity of response (i.e. rapidity of change of pulley contour) and freedom from interference with process conditions elsewhere in the casting apparatus.

In an alternative construction of the foregoing embodiment, wall 86 is omitted and shell 82 is supported directly on the end plates 88 and central disc 90, which are in turn fixed on a continuous unitary shaft 48 of substantial construction extending through the full axial dimension of the pulley. The spaces between the end plates and central disc can be supplied with hydraulic fluid to apply expansion-producing pressure on the expansible zones of the shell.

Figure 6:
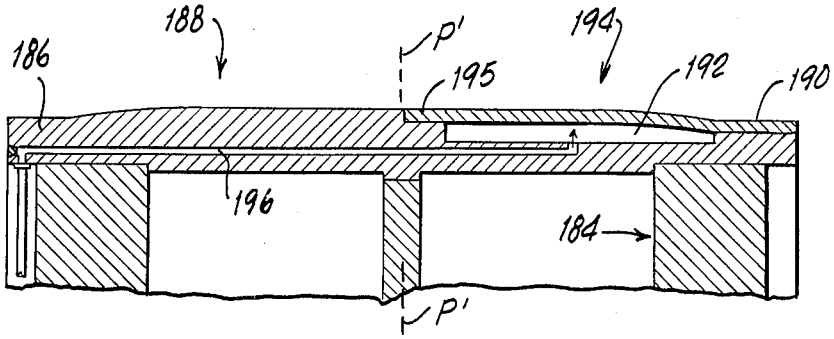
FIG. 6 is a view similar to FIG. 4, illustrating a modified embodiment of the pulley device of the invention.

FIG. 6 illustrates a modified embodiment of the pulley device, having outer structure which is circumferentially expansible at only a single zone. In this embodiment, a rigid, generally cylindrical pulley drum 184 has a wall 186 which itself constitutes the outer, belt-supporting structure of the pulley at a first zone 188 on one side of the median plane P'—P' of the pulley. On the other side of plane P'—P', the outer surface of wall 186 is recessed to receive a generally cylindrical and relatively thin-walled shell 190 and to define therewith an annular cavity 192 for hydraulic fluid. The portion of shell 190 overlying cavity 192 constitutes a second zone 194 of the outer, belt-supporting structure. The structure is circumferentially expansible at this second zone, in the same manner as the structure shown in FIGS. 2 – 5 is circumferentially expansible in each of zones 144 and 146, upon application of hydraulic pressure to the cavity 192 through a passage system 196 similar to that already described with reference to the FIG. 2 embodiment. It will be understood that the shell 190, as also its arrangement on the drum, and the associated means for applying hydraulic pressure, may be similar to the corresponding features of the FIG. 2 embodiment except that the shell 190 extends over only one half the pulley structure and has only a single expansible zone.

As illustrated, the drum wall 186 at zone 188 is crowned so that it has a fixed circumference greater than the minimum or unexpanded circumference of the shell 190 at zone 194. By application of hydraulic pressure through cavity 192, the shell at zone 194 can be expanded to a circumference which is less than, equal to (as shown in FIG. 6), or greater than that of the crowned zone 188 (depending upon the amount of pressure applied) to vary the lateral contour of the pulley, i.e. providing an effective transverse taper of the pulley in either direction as desired.

Figure 7:
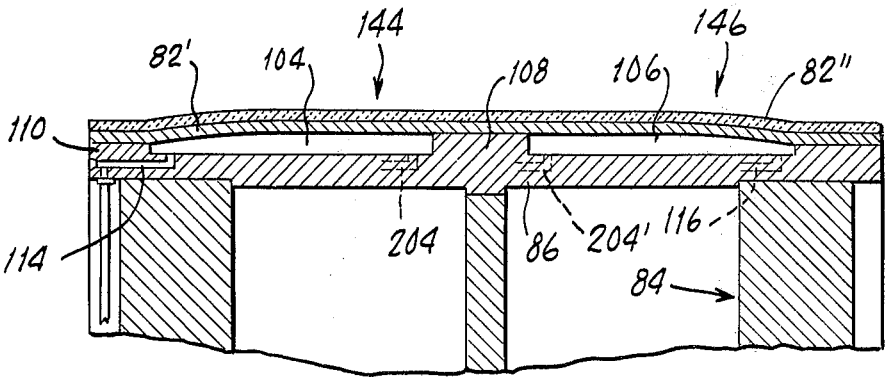
FIG. 7 is a view similar to FIG. 6, illustrating another modified embodiment of the invention.

The further modified pulley device of FIG. 7 is shown for convenience as being structurally similar to the embodiment of FIG. 2, i.e. having a drum 84 with a generally cylindrical wall 86 defining annular cavities 104 and 106 having separate fluid passages respectively designated 114 and 116, including drain passages 204 and 204', with a shell 82' fitted over the exterior of the drum. In this case, however, the shell 82' is provided with an outer layer 82'' of thermally insulating material, to separate the shell and the pulley structure from direct thermal contact with the belt so that a difference in temperature between the belt and the underlying structure can be established. For variation of circumference at either of the two zones 144 or 146, a cooling fluid or alternatively a heating fluid is supplied to the annular cavity 104 or 106 through the passages associated with that cavity, to cause contraction or expansion of the overlying shell portion in each zone. The contraction or expansion selectively alters the circumference of the shell in the zone to which cooling or heating fluid is applied and thereby again alters the lateral contour of the pulley as desired for positional control of a belt or web. Means alternative to circulating fluid passages (e.g. electrical heating means) may also be used to effect thermal variation in shell circumference. Indeed, thermal expansion means (i.e. heating means) may be used in combination with hydraulic expansion means (e.g. as shown in FIG. 2) to increase the range of attainable circumferential variation.

It will be appreciated that in the showings of FIGS. 5, 6 and 7, variations in circumference are substantially exaggerated for clarity of illustration.

In the practice of the present method with a variable contour pulley device, e.g. of one of the types described above, a climbing tendency or lateral deviation of the web or belt trained over the pulley device may, if desired be sensed by suitable microswitch means or other instrumentalities (not shown), and the means for supplying hydraulic or other fluid to the annular cavity or cavities of the pulley device may be operable under automatic control (not shown) in response to a switch signal representative of web or belt deviation. Suitable arrangements for such control instrumentalities will be readily apparent to those skilled in the art, and, as the details of such arrangements form no part of the present invention, they need not be further described.

It is to be understood that the invention is not limited to the features and embodiments hereinabove specifically set forth but may be carried out in other ways without departure from its spirit.

I claim:

1. In apparatus for the continuous casting of metal in strip form comprising a pair of moving surfaces which define a mold space between them and continuously travel through return paths to said mold space, at least one of said surfaces being a belt, the combination, with said belt, of a pulley device which carries said belt under tension through a change of direction in its return path while steering the belt against sidewise displacement, said device comprising:

a. a pulley including outer, belt-supporting structure, capable of withstanding the elevated temperature conditions encountered in a casting operation, for engaging said belt in at least two surface zones respectively located on opposite sides of the median plane of the pulley and variable in circumference at least at one of said zones; and b. means controllable to effect variation in the circumference of said structure at said one zone relative to the circumference of said structure at the other of said zones while said pulley is carrying the travelling belt, for adjusting the transverse profile of the outer surface of the pulley to keep the belt in a desired path on the pulley;

c. said structure being variable in circumference by said controllable means for altering the radius of said pulley at said one zone through an arc of contact of said pulley with said belt while said pulley is carrying said belt under tension.

2. Apparatus as defined in claim 1, wherein the circumference of said structure at said one zone can be made less than, equal to, or greater than the circumference of said structure at the other of said two zones.

3. Apparatus as defined in claim 1, wherein the circumference of said structure is variable at each of said two zones, and said controllable means comprises means controllable to effect variation in the circumference of said structure separately at each of said two zones.

4. Apparatus as defined in claim 3, wherein said zones are respectively near the edges of said structure.

5. Apparatus as defined in claim 1, wherein said structure is circumferentially expansible at said one zone and said controllable means comprises means controllable to effect expansion of said structure at said one zone.

6. In apparatus for the continuous casting of metal in strip form comprising a pair of moving belts which define a mold space between them and continuously travel through return paths to said mold space, the combination, with one of said belts, of a pulley device which carries said one belt under tension through a change of direction in its return path while steering the belt against sidewise displacement, said device comprising: a pulley having outer, belt-supporting structure which is capable of withstanding the elevated temperature conditions encountered in a casting operation and is circumferentially expansible at two surface zones, at least, that are on opposite sides of the median plane of said pulley, said pulley including means controllable to effect expansion of said structure separately at each of said zones while said pulley is carrying the travelling belt, so that by mutually relative expansion of the zones, the transverse profile of the belt-supporting surface of the pulley can be adjusted to desired configuration; said structure being variable in circumference by said controllable means for altering the radius of said pulley at each of said zones through an arc of contact of said pulley with said belt while said pulley is carrying said belt under tension.

7. Apparatus as defined in claim 6 in which the expansion-effecting means comprises means providing annular cavities beneath the surface of said structure respectively at said zones, and means for supplying fluid under pressure to said cavities, controllable individually for the cavities to effect expansion of the structure separately to desired extent at each zone.

8. Apparatus as defined in claim 7 in which the outer structure comprises a metal shell having an outer, normally cylindrical, belt-carrying surface, said expansion-effecting means comprising inner structure which has associated means journalling the pulley for rotation and is arranged to support said shell at its lateral edges and at a central region, said inner structure being shaped to provide, in cooperation with said shell, said pair of annular cavities under the shell respectively at said zones, and said fluid supply means comprising a pair of conduit means extending respectively from said cavities through the journalling means, and means to supply hydraulic fluid under pressure to said conduit means, controllable for selectively differentially expanding said zones of the shell relative to each other.

9. In apparatus for the continuous casting of metal in strip form comprising a pair of moving belts which define a mold space between them and continuously travel through return paths to said mold space, the combination, with one of said belts, of a pulley device which carries said one belt under tension through a change of direction in its return path while steering the belt against sidewise displacement, said belt being susceptible of departure from dimensional uniformity such as to cause a taper between its edges during such change of direction, that tends to shift the belt sidewise on a pulley, said device comprising: a rotatable pulley having an outer shell with a normally cylindrical outer surface for carrying the belt, said shell being circumferentially expansible at each of a plurality of zones distributed axially of the shell and capable of withstanding the elevated temperature conditions encountered in a casting operation, said pulley including inner structure which interiorly supports said shell and which includes means controllable to exert outward pressure on said shell separately at each of the aforesaid zones while said pulley is carrying the travelling belt, for differentially altering the outer diameter of the shell by expansion relatively among said zones, so that when the belt assumes a taper on the pulley, the outer shell surface can be given a tapering shape that opposes the tendency of the belt to shift sidewise; said shell being expansible by said controllable means for increasing the radius of said pulley at each of said zones through an arc of contact of said pulley with said belt while said pulley is carrying said belt under tension.

10. Apparatus as defined in claim 9 in which said shell and inner structure are mutually shaped to provide a plurality of annular cavities respectively corresponding to said zones and exposed to the inner side of the shell, said shell being integrated with the inner structure at the circumferential boundaries of the zones for edgewise enclosing each cavity, said controllable means including conduit means extending separately from said cavities to be supplied with fluid under pressure, and means connected to the conduit means for individually controlling the pressure of fluid supply to each cavity, so that the aforesaid differential expansion can be effected among the zones by fluid pressure in the cavities.

11. In apparatus for the continuous casting of metal in strip form comprising a pair of moving belts which define a mold space between them and continuously travel through return paths to said mold space, the combination, with one of said belts, of a pulley which carries said one belt under tension through a change of direction in its return path, and means for steering the belt against sidewise displacement on said pulley, comprising outer, belt-supporting structure of the pulley which is capable of withstanding the elevated temperature conditions encountered in a casting operation and is circumferentially expansible at two surface zones, at least, that are respectively near the edges of said structure, and means controllable to effect expansion of said structure separately at each of said zones while said pulley is carrying the travelling belt, for adjusting the transverse profile of the outer surface of the pulley to keep the belt in a desired path on the pulley; said structure being expansible by said controllable means for increasing the radius of said pulley at each of said zones through an arc of contact of said pulley with said belt while said pulley is carrying said belt under tension.

12. Apparatus as defined in claim 11 in which said structure comprises outer metal shell means and said controllable means comprises inner structure coacting with said shell means to provide a pair of annular cavities underlying said zones, and means controllable to supply fluid under pressure individually to said cavities for expanding said shell means differentially at the zones to effect said profile adjustment.

13. In procedure for continuously casting metal in strip form between a pair of moving belts which define a mold space between them and continuously travel through return paths to said mold space, a method of steering one of the belts, comprising continuously advancing the belt through a change of direction over a pulley which is arranged with a belt-carrying surface that can be circumferentially expanded separately at two zones, at least, respectively near the edges of the belt path over the pulley, sensing a tendency of the belt to move laterally on the pulley, and adjusting the lateral contour of said surface through an arc of contact of said pulley with said belt while said pulley is carrying said belt under tension by differentially subjecting said zones to expanding force, for counteracting said tendency of the belt.

14. In procedure for continuously casting metal in strip form between a pair of moving belts which define a mold space between them and continuously travel through return paths to said mold space, a method of steering one of the belts, comprising continuously advancing the belt through a change of direction over a pulley which is arranged with a belt-carrying surface that can be circumferentially-expanded separately at two zones, at least, respectively near the edges of the belt path over the pulley, supplying fluid under pressure to said pulley interiorly beneath said zones, sensing a tendency of the belt to move laterally on the pulley, and adjusting the lateral contour of said surface through an arc of contact of said pulley with said belt while said pulley is carrying said belt under tension by controlling the pressure of said fluid beneath the respective zones for differentially effecting expansion of the surface, to counteract said tendency of the belt.

15. In procedure for continuously casting metal in strip form between a pair of moving belts which define a mold space between them and continuously travel through return paths to said mold space, a method of steering one of the belts, comprising continuously advancing the belt through a change of direction over a pulley which is arranged with a belt-carrying surface that can be varied in circumference at least at one of two axially distributed belt-engaging zones, sensing a tendency of the belt to move laterally on the pulley, and adjusting the lateral contour of the surface through an arc of contact of said pulley with said belt while said pulley is carrying said belt under tension by varying the circumference of the surface at said one zone relative to the circumference at the other of said zones for counteracting said tendency of the belt.

* * * * *